United States Patent [19]

Weisler

[11] 4,080,673

[45] Mar. 28, 1978

[54] BED ROCKING MECHANISM

[76] Inventor: Morris J. Weisler, 358 Sharon Dr., (Lakewood North) New Orleans, La. 70124

[21] Appl. No.: 768,910

[22] Filed: Feb. 15, 1977

Related U.S. Application Data

[63] Continuation of Ser. No. 631,626, Nov. 13, 1975.

[51] Int. Cl.[2] ..... A61G 7/00; A61G 7/10

[52] U.S. Cl. ..... 5/62; 5/85; 5/108; 128/33

[58] Field of Search ..... 5/108, 109, 61, 62, 5/83, 84, 85; 128/33

[56] References Cited

U.S. PATENT DOCUMENTS

| | | | |
|---|---|---|---|
| 3,247,528 | 4/1966 | Swenson et al. | 5/62 |
| 3,506,985 | 4/1970 | Lang | 5/61 |
| 3,564,625 | 2/1971 | Danielson | 5/61 |

*Primary Examiner*—Paul R. Gilliam
*Assistant Examiner*—Alex Grosz
*Attorney, Agent, or Firm*—Hopgood, Calimafde, Kalil, Blaustein and Lieberman

[57] ABSTRACT

Portable apparatus for imparting a rocking motion to a bed includes at least one vertically reciprocating mechanism disposable at one side of the bed and a first horizontally oriented bar connected to the reciprocating mechanism. A support structure including a second horizontally oriented bar is disposed adjacent to the opposed side of the bed. Cables or flexible webs are connected between the respective opposite ends of the two bars passing beneath the bed to support the bed above the floor. Controls are provided to actuate the vertically reciprocating mechanism at a predetermined frequency and vertical displacement to provide the desired rocking motion.

12 Claims, 5 Drawing Figures

BED ROCKING MECHANISM

This is a continuation of Ser. No. 631,626, filed Nov. 13, 1975.

BACKGROUND OF THE INVENTION

Bedridden patients are often plagued by bed sores occurring on portions of their body which have been in prolonged contact with the bed surface. This condition can be alleviated or wholly prevented by periodically changing the relative position of the patient in the bed. In addition to alleviating the problem of bed sores it is known that persons have a natural tendency to want to shift their position during periods of sleep and that they rest more comfortably when able to do so. Many patients because of the nature of their illnesses or injuries cannot move in bed without assistance and this necessary motion must be provided either manually by members of the hospital staff or by mechanical means.

One means to periodically move bedridden patients would be to provide a mechanism which would rock the bed back and forth transversely causing motion of the patient on the bed. Mechanisms to provide this motion can be incorporated in the bed frame, as shown in U.S. Pat. Nos. 2,311,542 and 3,748,666. Doing this, however, greatly increases the cost of hospital beds as well as making such beds undesirably heavy and difficult to move. Since this rocking feature is not necessary for all hospital patients it would be desirable to provide portable apparatus which can be attached to existing bed frames to provide this rocking motion selectively when and where needed for a particular patient at a particular time.

The portable apparatus described herein provides this desirable feature by utilizing portable relatively light components which can be used to provide a rocking motion with existing bed frames when needed for a particular patient and can be easily removed for use elsewhere or for storage when no longer needed. Such a device can be transported throughout a health care facility for use in turn on different beds and to serve the needs of various patients, thereby removing the need to transport heavy bulky beds over great distances or in the alternative transport patients throughout the facility.

SUMMARY OF THE INVENTION

Portable apparatus for imparting a rocking motion to a bed which is used for convalescing patients includes a first vertically reciprocating mechanism including a first horizontally oriented bar movable in a substantially vertical plane disposable at a first side of the bed and a support member including a second horizontally oriented bar disposable at a second side of the bed. Linking means are provided to operably connect the first bar to the first side of the bed and the second bar to the second side of the bed. Control means are provided to actuate the first reciprocating mechanism at a frequency and vertical displacement commensurate with the desired rocking motion to be imparted to the bed.

DESCRIPTION OF THE INVENTION

Figure 1:
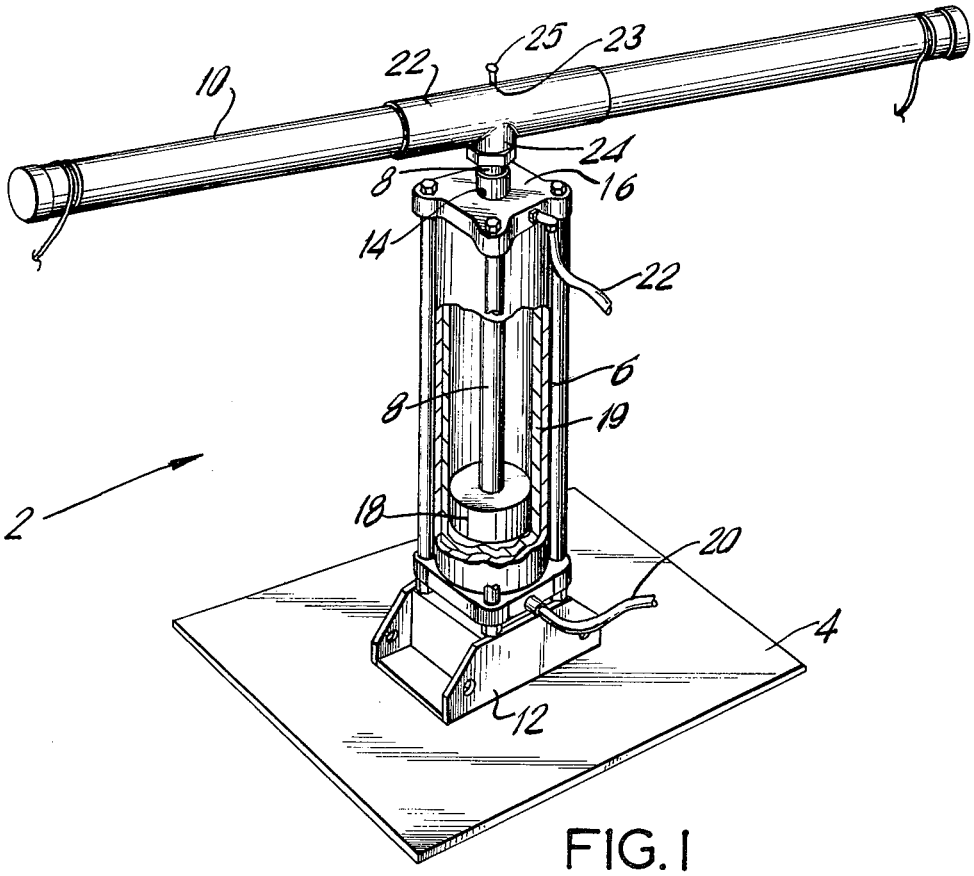
FIG. 1 shows a partially cut away view of a preferred embodiment of a reciprocating mechanism for use with the bed rocking apparatus.

FIG. 1 shows a preferred embodiment of a mechanism 2 to generate a vertically reciprocating motion for use with bed rocking apparatus. The reciprocating mechanism includes a base plate 4, a hydraulic cylinder 6 mounted on the base plate 4, a rod 8 activated by cylinder 6 and a horizontally oriented member 10 attached to and movable with the rod 8. The base plate 4 is preferably a flat sheet-like member of metallic or other suitable material which provides a stable mounting on a support surface and resists lateral motion of the cylinder 6. The cylinder 6 is fixedly attached to base plate 4 by a mounting bracket 12 which is preferably welded to the upper surface of plate 4. Cylinder 6, which is preferably a hydraulic cylinder, is fixedly attached to bracket 12 by suitable means such as nuts and bolts. The connection between the cylinder 6 and bracket 12 must be such as to prevent relative motion between the cylinder 6 and bracket 12 thereby holding the cylinder in a stable orientation in which its longitudinal axis is substantially perpendicular to base plate 4 and therefore to the support surface.

Cylinder 6 includes a movable rod 8 extending through an aperture 14 in the upper surface 16 of the cylinder. The rod 8 is connected to a piston 18 which moves upward and downward within a cylinder 19 in response to pressure exerted by a pressurized fluid such as air or other suitable gas which is applied to the cylinder 19 through lower and upper conduits 20 and 22 to cause piston 18 to move respectively downwardly and upwardly within inner cylinder 19. Pressurized air is supplied by a regulator 50 through a control arrangement shown in FIG. 3 and described below. Other fluids such as oil may be substituted for air by suitable modifications of the hydraulic cylinder and control apparatus.

Other mechanisms can, of course, be substituted for the hydraulic cylinder described above to generate a verticle reciprocating motion. One such alternative mechanism would be an electric motor with a pulley driven screw such as is well known in the art.

An elongated horizontally disposed rod 10, is attached at its midpoint to movable rod 8. One means for such attachment is shown in FIG. 1 and includes a collar 22 configured to fit over the outer surface of member 10. The collar 22 includes a cylindrical member 24 configured to fit over the projecting end of rod 8 which extends through aperture 14 in the top 16 of cylinder 6. The member 24 has an internal diameter which is configured to fit over and be fixedly attached to the top and outer circumference of rod 8. The collar 22 is configured so that rod 10 is rotatable within it and includes an aperture 23 which aligns with one of a series of similar apertures (not shown) extending in circular configuration about the periphery of rod 10. A pin 25 is insertable through aperture 23 and one of the apertures in rod 10 to lock rod 10 at a desired position. If greater mechanical advantage is desired to adjust rod 10 a handle can be used to rotate the rod 10 within collar 22 to the proper position or a gearing arrangement linked to a handle can be used. In either case a brake can be used to hold the handle and the rod 10 at the desired position.

Figure 2:
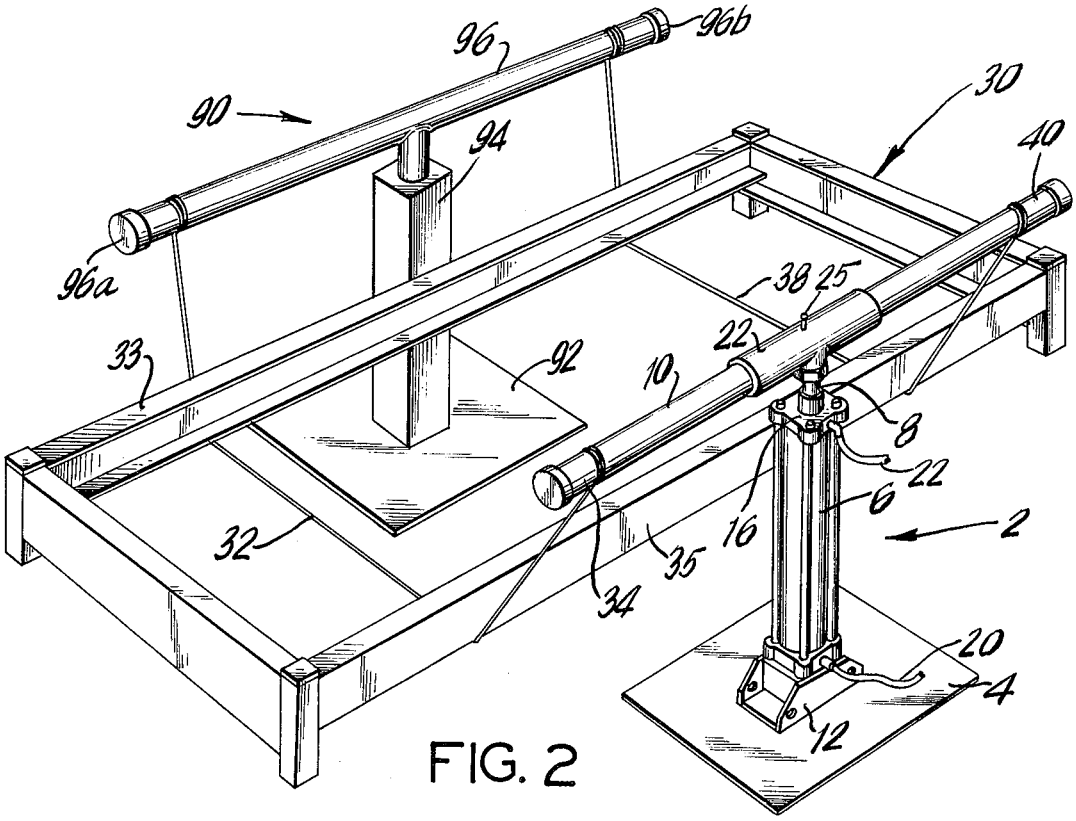
FIG. 2 shows a first embodiment of the bed rocking apparatus operably connected to a bed frame.

A support structure 90 as shown in FIG. 2 includes a base 92, a vertical support member 94 fixedly attached, as for example by welding, to the base 92 and a horizontal bar 96 fixedly attached at approximately its center point to verticle support member 94. The support member 90 is disposed adjacent to one side 33 of the bed 30 with the longitudinal axis of the horizontal bar 96 substantially aligned with the longitudinal side 33 of the bed frame. The hydraulic cylinder 2, or other mechanism for generating vertically reciprocating motion, is disposed adjacent to the opposed longitudinal side 35 of bed 30 with the rod 10 substantially aligned with the side 35.

Horizontal rod 96 and rod 10 are connected together by cables such as 32 and 38 as seen in FIG. 2. The cable 32 is connected respectively between the opposite ends 96*a* and 34*a* of rod 96 and member 10 while the cable 38 is connected between ends 96*b* and 40. If desired additional cables may be connected between the rods 96 and 10 at spaced longitudinal points. After all cables are connected the rod 10 is rotated within collar 22 to tighten the cables and thereby to lift bed 30 off the floor so that the bed is suspended between the support member 90 and the vertical reciprocating mechanism 2 resting on the cables 32 and 38. The pin 25 is then inserted through aperture 23 in collar 22 and into one of the mating apertures in the rod 10 to lock the member 10 in position and maintain the bed 30 at the desired height.

As can be seen in FIG. 2 the cables 32 and 38 are in contact with each of the opposed sides 33 and 35 when the bed 30 is in its raised position. The cables 32 and 38 are preferably chosen so that they provide an adequate frictional force against the bed sides to prevent the bed 30 from sliding against them during the verticle reciprocating motion of mechanism 2. If desired webs of flexible material having adequate strength can be utilized rather than cables 32 and 38.

Alternatively cables or other flexible linking members may be attached between the rod 10 and adjacent side 35 and rod 96 and adjacent side 33. If desired removable clamps can be attached at points along the bed frame and the cables or other linking members can then be attached to eyes in the clamps by hooks attached to the ends of the linking members or alternatively apertures may be provided in the bed frame through which hooks at the end of the linking members may be attached. Means are then provided to rotate the rod 96 such as the collar 22 and locking pin 25 utilized with mechanism 2 so that the cables on each side 33 and 35 of the bed 30 can be adjusted independently to support the bed 30 at the desired height above the floor.

Figure 3:
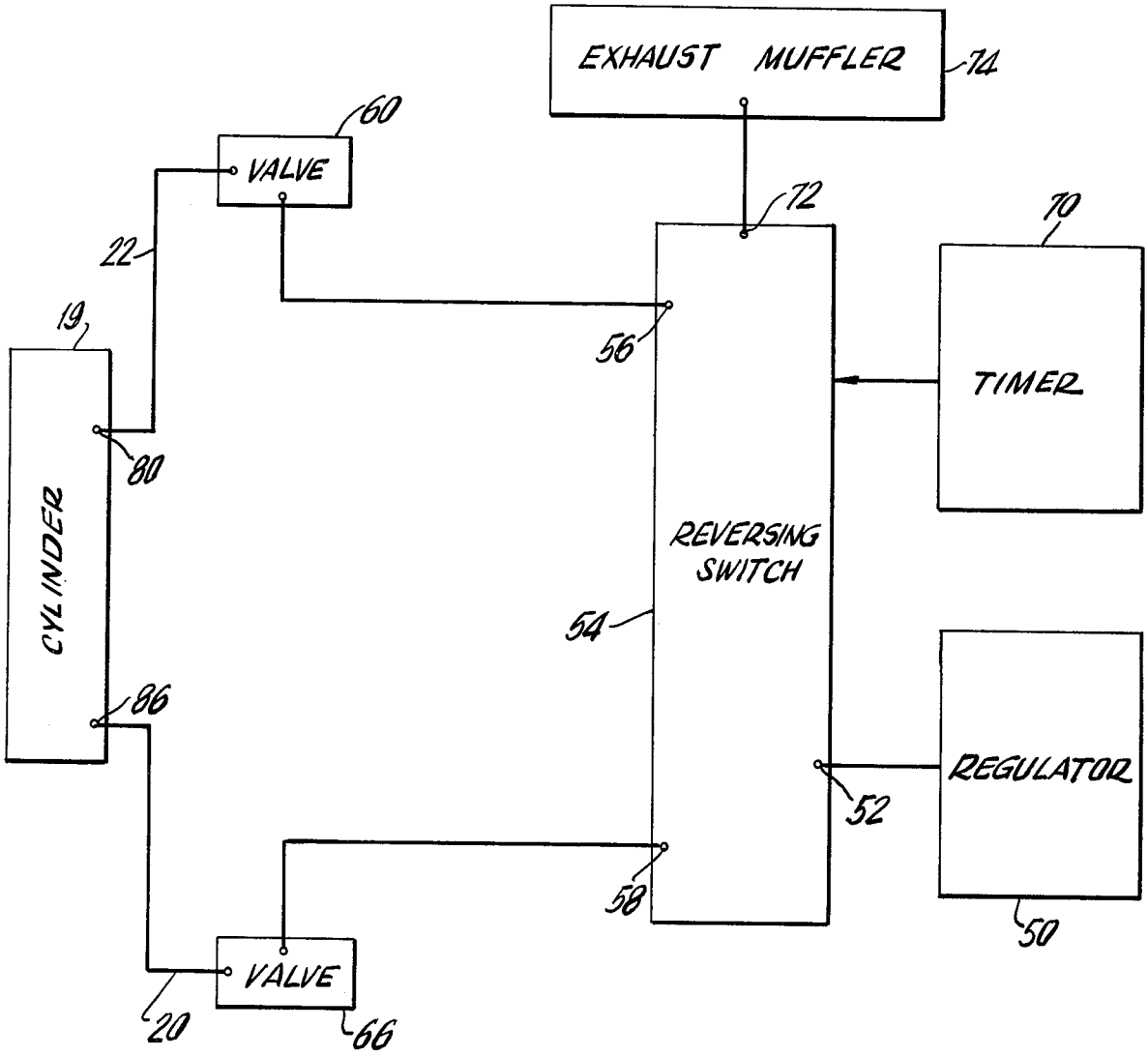
FIG. 3 shows a block diagram of the control circuitry for the first embodiment of the bed rocking apparatus.

Control apparatus to operate the vertically reciprocating mechanism 2 is shown in block diagram form as FIG. 3. A regulator 50 supplies air to the input terminal 52 of a reversing switch 54. The regulator may be any known apparatus of this type which is capable of supplying air to input terminal 52 at a pressure within the range of 50 to 100 psi. By adjusting the pressure at regulator 50 the distance of vertical travel of piston 18, connecting rod 8 and rod 10, can be varied to increase or decrease the amplitude of the rocking motion. A first and second outputs 56 and 58 of the reversing switch 54 are connected respectively to a first needle valve 60 and to a second needle valve 66. The valve 60 is connected through conduit 22 to the top of cylinder 19, while valve 66 is connected through conduit 20 to the bottom of cylinder 19. A timer 70, which may be any conventional 24 hour timer, is connected to reversing switch 54 to cause it to supply incoming air from regulator 50 alternately to outputs 56 and 58. The period of switching between outputs 56 and 58 is preset by adjustment of timer 70. The frequency of the rocking motion may be set by adjusting timer 70. A fourth output 72 of reversing switch 54 is connected to an exhaust muffler 74.

The operation of the bed rocking apparatus will now be described with reference to FIGS. 2 and 3. The regulator 50 supplies air at a predetermined pressure to the input 52 of reversing switch 54. Assume arbitrarily that the reversing switch at that point in time supplies the air through output 56 to the first valve 60. Valve 60 acts to supply air through conduit 22 to the upper input port 80 of cylinder 19 causing the piston 18 and connecting rod 8 to move downward within cylinder 19 which in turn causes the attached cross member 10 to move downward, lowering the cables 32 and 34 on the side 35 of the bed 30 and thereby lowering that side of the bed 30. Side 35 is at that point lower than side 30 so that the bed slopes.

At the end of a preset period timer 70 activates reversing switch 54 cutting off the air supply to exist port 56 and directing it through port 58 to the second valve 66. Valve 66 supplies air to lower port 86 of cylinder 19 forcing piston 18 and attached rod 8 and cross member 10 upward. This causes side 35 of bed 30 to move upward through a midpoint even with stationary side 33 to a maximum point higher than side 33. The bed 30 is then sloping in the opposite direction. Exhaust air is forced outward from cylinder 19 through port 80 thence through conduit 22, valve 60 and reversing valve 54 where it exists through output port 72 to exhaust muffler 74. By switching periodically between the first valve 60, the second valve 66, the bed 30 can be rocked gently back and forth repeating the cycle described above.

Figure 4:
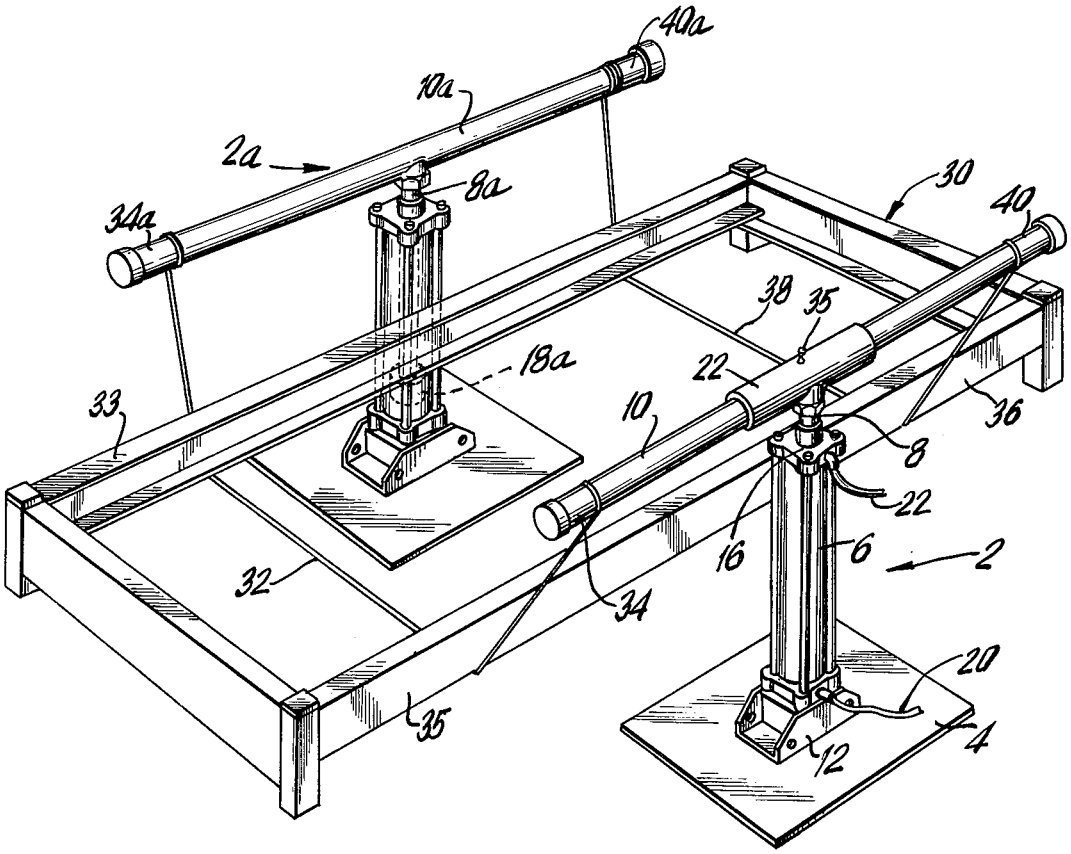
FIG. 4 shows a second embodiment of the bed rocking apparatus operably connected to the bed.

An alternative embodiment of the bed rocking apparatus is shown in FIG. 4. In this embodiment the bed rocking apparatus includes a second reciprocating mechanism 2*a* rather than the stationary support member 90. The mechanism 2*a* is substantially identical to mechanism 2 described in detail above. The two reciprocating members 2 and 2*a* are disposed adjacent to opposed bedsides 35 and 33 and support the bed off the floor as shown in FIG. 4 and described more fully above with the second reciprocating mechanism 2*a* replacing the support member 90 on bedside 35.

Figure 3A:
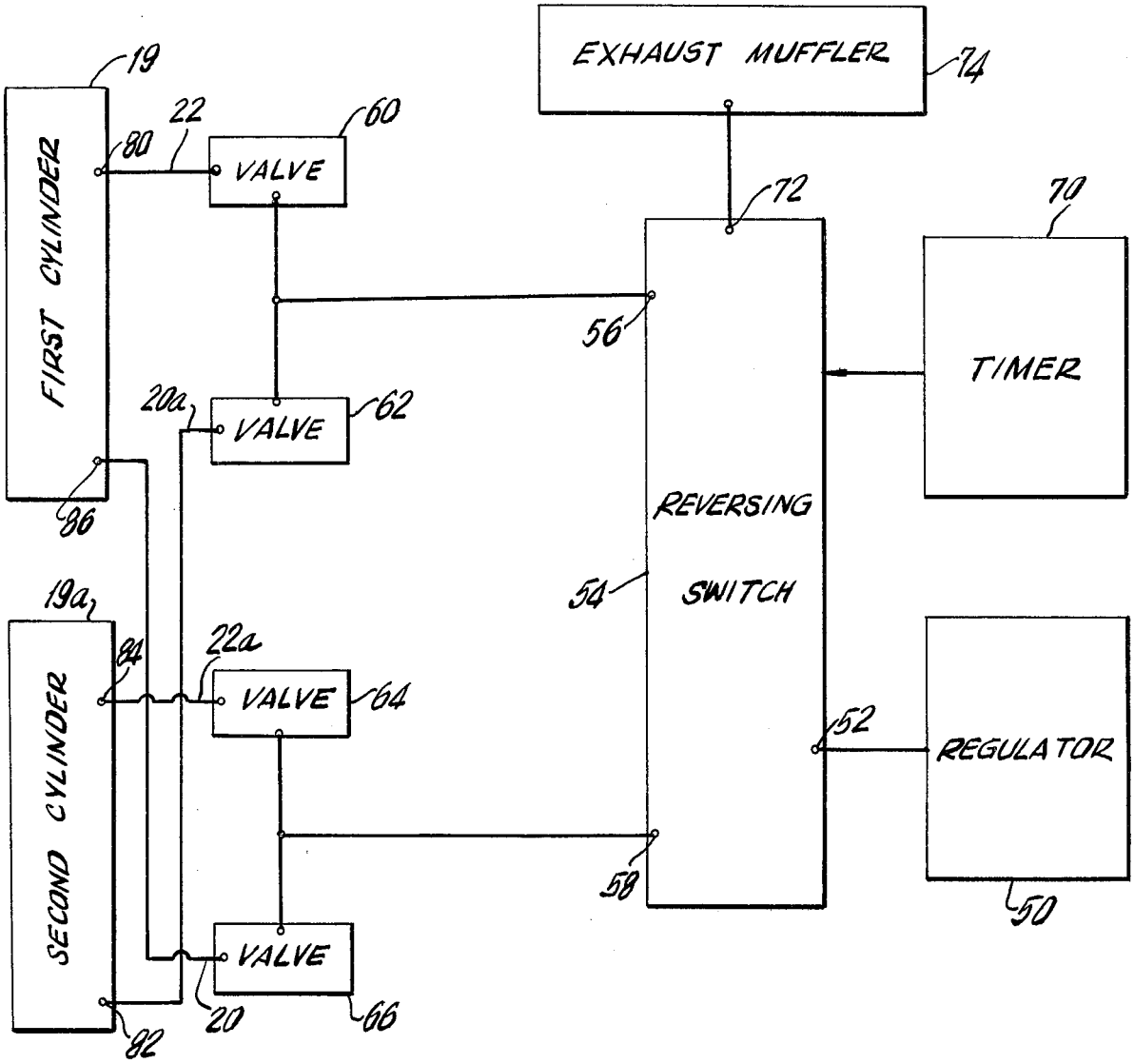
FIG. 3*a* shows a block diagram of the control circuitry for the second embodiment of the bed rocking apparatus.

Control apparatus to operate the rocking mechanisms 2 and 2*a* of this embodiment is shown in block diagram form as FIG. 3*a*. A regulator 50 supplies air to the input terminal 52 of a reversing switch 54. The regulator may be any known apparatus of this type which is capable of supplying air to input terminal 52 at a pressure within the range of 50 to 100 psi. A first and second outputs 56 and 58 of the reversing switch 54 are connected respectively to a first pair of needle valves 60 and 62 and to a second pair of needle valves 64 and 66. In the first pair of valves, valve 60 is connected through conduit 22 to the top of cylinder 19 while valve 62 is connected through conduit 20*a* to the bottom of cylinder 19*a*. In the second pair of needle valves, valve 64 is connected through conduit 22*a* to the top of cylinder 19*a* while valve 66 is connected through conduit 20 to the bottom of cylinder 19. A timer 70, which may be any conventional 24 hour timer, is connected to reversing switch 54 to cause it to supply incoming air from regulator 50 alternately to outputs 56 and 58. The period of switching between outputs 56 and 58 is preset by adjustment of timer 70. A fourth output 72 of reversing switch 54 is connected to an exhaust muffler 74.

The operation of this embodiment of the bed rocking apparatus will now be described with reference to FIGS. 4 and 3*a*. The regulator 50 supplies air under predetermined pressure to the input 52 of reversing switch 54. Assume arbitrarily that the reversing switch at that point in time supplies the air through output 56 to the first pair of valves 60 and 62. Valve 60 acts to supply air through conduit 22 to the upper input port 80 of cylinder 19 causing the piston 18 and connecting rod 8 to move downward within cylinder 19 which in turn causes the attached rod 10 to move downward, lowering the cables 32 and 34 on the side 35 of the bed 30 causing side 35 to move downwardly. Simultaneously valve 62 supplies air through conduit 20*a* to the lower port 82 of cylinder 19*a* causing piston 18 and attached rod 8*a* to move upward. This in turn causes rod 10*a* to move upward pulling upward on cables 32 and 34 and lifting the side of the bed 30 adjacent to cross member 10*a*.

At the end of a preset period timer 70 activates reversing switch 54 cutting off the air supply to exit port 56 and directing it through port 58 to the second pair of valves 64 and 66. Valve 64 supplies air through conduit 22*a* to the upper port 84 of cylinder 19*a* forcing piston 18*a* and attached rod 8*a* and rod 10*a* downward. Exhaust air from cylinder 19*a* is forced outward through port 82 in cylinder 19*a* and through conduit 20*a*, valve 62 and reversing switch 54 to exhaust muffler 74. Valve 66 simultaneously supplies air to lower port 86 of cylinder 19 forcing piston 18 and attached rod 8 and cross member 10 upward. Exhaust air is forced outward from cylinder 19 through port 80 thence through conduit 22, valve 60 and reversing valve 54 where it exists through output port 72 to exhaust muffler 74. The motion resulting from activating valves 64 and 66 is exactly the converse of that resulting from the activation of valves 60 and 62 so that the bed 30 is caused to tilt in the opposite direction.

By switching periodically between the first pair of valves 60 and 62 and the second pair of valves 64 and 66 the bed 30 can be rocked gently back and forth. The period of this rocking motion may be adjusted by timer 70 which controls the reversing switch 54. The amplitude of the rocking motion may be adjusted by adjusting the incoming fluid pressure from regulator 50. In this second embodiment the bed 30 is rocked back and forth about an axis running longitudinally down its center while in the first embodiment the rocking motion is about an axis running down the stationary side 33. Either embodiment may, however, be utilized to provide a suitable rocking motion.

Although the present invention has been described in conjunction with preferred embodiments, it is to be understood that modifications and variations may be resorted to without departing from the spirit and scope of the invention as those skilled in the art will readily understand. Such modifications and variations are condiers to be within the purview and scope of the invention and appended claims.

I claim:

1. Portable apparatus for imparting a rocking motion to a bed having a first and second substantially opposed sides including:

first support means having a base, a cylinder having a first end mounted on said base and a second end, a piston reciprocally movable within said cylinder, a piston rod attached to said piston at a first end and having a second end extending through said second end of said cylinder, and a first member attached to said piston rod at a point adjacent to the second end of said piston rod, said first member being movable by the motion of said piston rod;

second support means including a second member and a base to support said second member;

linking means to operably connect said first member to said first side of said bed and said second member to said second side of said bed;

a source of pressurized fluid;

a reversing switch having an input connected to said source of pressurized fluid and a first and second outputs;

first and second valves connected respectively to said first and second outputs of said reversing switch, said first valve being connected to said first end of said cylinder and said second valve being connected to said second end of said cylinder; and timing means to cause said reversing switch alternately to direct said pressurized fluid through said first and said second outputs to cause said first member to move so as to alternately lift and lower said first side of said bed.

2. Portable apparatus as claimed in claim 1 wherein said linking means includes means to connect said first and second members.

3. Portable apparatus for imparting a rocking motion to a bed having a first and second substantially opposed sides including:

first support means having a base, a cylinder having a first end mounted on said base and a second end, a piston reciprocally movable within said cylinder, a piston rod attached to said piston at a first end and having a second end extending through said second end of said cylinder, and a first horizontally oriented member attached to said piston rod at a point adjacent to the second end of said piston rod, said first horizontally oriented member being movable in a substantially vertical plane by the motion of said piston rod;

second support means including a second horizontally oriented member and a base to support said second horizontally oriented member at a predetermined verticle height;

linking means to operably connect said first horizontally oriented member to said first side of said bed and said second horizontally oriented member to said second side of said bed;

a source of pressurized fluid;

a reversing switch having an input connected to said source of pressurized fluid and a first and second outputs;

first and second valves connected respectively to said first and second outputs of said reversing switch, said first valve being connected to said first end of said cylinder and said second valve being connected to said second end of said cylinder; and timing means to cause said reversing switch alternately to direct said pressurized fluid through said first and said second outputs to cause said first horizontally oriented member to move reciprocally in said vertical plane to alternately lift and lower said first side of said bed.

4. Portable apparatus as claimed in claim 3 in which said linking means include at least two flexible connecting members said connecting members being connected to and extending between the respective opposed ends of said first and said second horizontally oriented members, said elongated flexible connecting members passing beneath said bed.

5. Portable apparatus as claimed in claim 3 in which said linking means include at least a first two flexible connecting members connected respectively between the ends of said first horizontally oriented member and two longitudinally spaced points on said first side of said bed and at least a second two flexible connecting members connected respectively between the ends of said second horizontally oriented member and two longitudinally spaced points on said second side of said bed.

6. Portable apparatus as claimed in claim 5 including coupling means for removably attaching each of said flexible connecting members respectively to said points on the sides of said bed.

7. Portable apparatus as claimed in claim 3 in which said reversing switch includes a third output and in which an exhaust muffler is connected to said third output.

8. Portable apparatus for imparting a rocking motion to a bed having a longitudinal axis and a first and second substantially opposed sides including:

a first and second hydraulic cylinders, each of which includes a cylinder having first and second ends, a piston reciprocally movable within said cylinder between said first and second ends, and a piston rod attached to and movable with said piston said piston rod having a portion extending out of said cylinder at said second end, and a horizontally disposed member attached to said portion of said piston rod and movable by said piston rod in a substantially verticle plane;

linking means to operably connect said horizontally disposed member of said first reciprocating mechanism to said first side of said bed and said horizontally disposed member of said second reciprocating mechanism to said second side of said bed;

a source of pressurized fluid;

a reversing switch having an input connected to said source of pressurized fluid and first and second outputs;

first and second valves connected to said first output of said reversing switch and third and fourth valves connected to said second output of said reversing switch;

said first valve being connected to said first end of said cylinder of said first hydraulic cylinder and said second valve being connected to said second end of said cylinder of said second hydraulic cylinder, said third valve being connected to said first end of said cylinder of said second hydraulic cylinder and said fourth valve being connected to said second end of said cylinder of said first hydraulic cylinder; and timing means to cause said reversing switch alternately to direct said pressurized fluid through said first and said second outputs causing said first and second horizontally disposed members to move in mutually opposed reciprocal motion to alternatively lift and lower each of said opposed sides of said bed to rock said bed about said longitudinal axis.

9. Portable apparatus as claimed in claim 8 in which said linking means include at least two elongated flexible members having ends connected to and extending respectively between opposed ends of said horizontally oriented members of said first and second hydraulic cylinders, said elongated flexible members passing beneath said bed.

10. Portable apparatus as claimed in claim 8 in which said reversing switch includes a third output and in which an exhaust muffler is connected to said third output.

11. Portable apparatus as claimed in claim 8 in which at least one of said first and second horizontally oriented members is a rod which is rotatable about its longitudinal axis and including locking means to lock said rotatable rod at a desired position.

12. Portable apparatus as claimed in claim 8 in which said linking means include at least a first two flexible connecting members connected respectively between the ends of said horizontally oriented member of said first hydraulic cylinder and two longitudinally spaced points on said first side of said bed and at least a second two flexible connecting members connected respectively between the ends of said horizontally oriented member of said second hydraulic cylinder and two longitudinally spaced points on said second side of said bed.

* * * * *